US006564593B1

(12) United States Patent
Nardini

(10) Patent No.: US 6,564,593 B1
(45) Date of Patent: May 20, 2003

(54) PROCESS AND SYSTEM FOR ELIMINATING OXYGEN IN THE INTERNAL ATMOSPHERE OF DRY CLEANING MACHINES BY CATALYTICALLY BURNING IT WITH THE SOLVENT VAPORS

(75) Inventor: Gian Vieri Nardini, Riccione (IT)

(73) Assignee: Lindus S.r.l., Bologna (IT)

( * ) Notice: Subject to any disclaimer, the term of this patent is extended or adjusted under 35 U.S.C. 154(b) by 212 days.

(21) Appl. No.: 09/710,812

(22) Filed: Nov. 13, 2000

(30) Foreign Application Priority Data

Jun. 9, 2000 (IT) ..... BO00A0344

(51) Int. Cl.[7] ..... D06B 5/22
(52) U.S. Cl. ..... 68/18 R; 134/105
(58) Field of Search ..... 134/105; 68/5 R, 68/18 R, 18 C

(56) References Cited

U.S. PATENT DOCUMENTS 2,446,076 A * 7/1948 Campbell et al.
2,735,822 A * 2/1956 Campbell et al.
3,491,707 A * 1/1970 Bakker
3,598,063 A * 8/1971 Kalkhof
4,898,601 A * 2/1990 Casey

* cited by examiner

*Primary Examiner*—Frankie L. Stinson
(74) *Attorney, Agent, or Firm*—Harrison & Egbert

(57) ABSTRACT

A process and system for eliminating oxygen in the internal atmosphere of dry cleaning machines by catalytically burning it with the solvent vapors including the process and the relative circuit, which makes the atmosphere within the dry cleaning machine inert, controlling the process by measuring the oxygen in the gaseous mass, obtained using one or a number of Lambda probes.

3 Claims, 2 Drawing Sheets

PROCESS AND SYSTEM FOR ELIMINATING OXYGEN IN THE INTERNAL ATMOSPHERE OF DRY CLEANING MACHINES BY CATALYTICALLY BURNING IT WITH THE SOLVENT VAPORS

BACKGROUND OF THE INVENTION

1. Field of the Invention

The present invention relates to a new device of the machine system commonly named "DRY CLEANING MACHINE" used to clean clothes, fabrics or metal objects by means of a solvent other than water and therefore subject to the risk of explosion or fire due to the flammability of the solvent.

2. Description of Related Art

The present invention is an improvement of the invention already described in a previous Italian patent application no. BO 99 A 000333 by the same applicant.

BRIEF SUMMARY OF THE INVENTION

The present invention described herewith, designed for a traditional dry cleaning machine, entails the elimination of the oxygen in the atmosphere within the machine at the beginning of each cleaning cycle by means of the controlled combustion on a catalytic bed. The combustible used is the same solvent used to clean, kept as vapour in a flow of air. The main improvement currently added consists of the crucial addition of one or a number of sensors, namely probes that are sensitive to the concentration of oxygen, the signals of which are utilized to control the oxygen elimination process until stopping it when the desired concentration is reached.

This and other characteristics will further relate to a simple form of the invention given as indicated, which is not binding, on the scope of this patent.

BRIEF DESCRIPTION OF THE SEVERAL VIEWS OF THE DRAWINGS

Referring to the enclosed drawings.

DETAILED DESCRIPTION OF THE INVENTION

Figure 1:
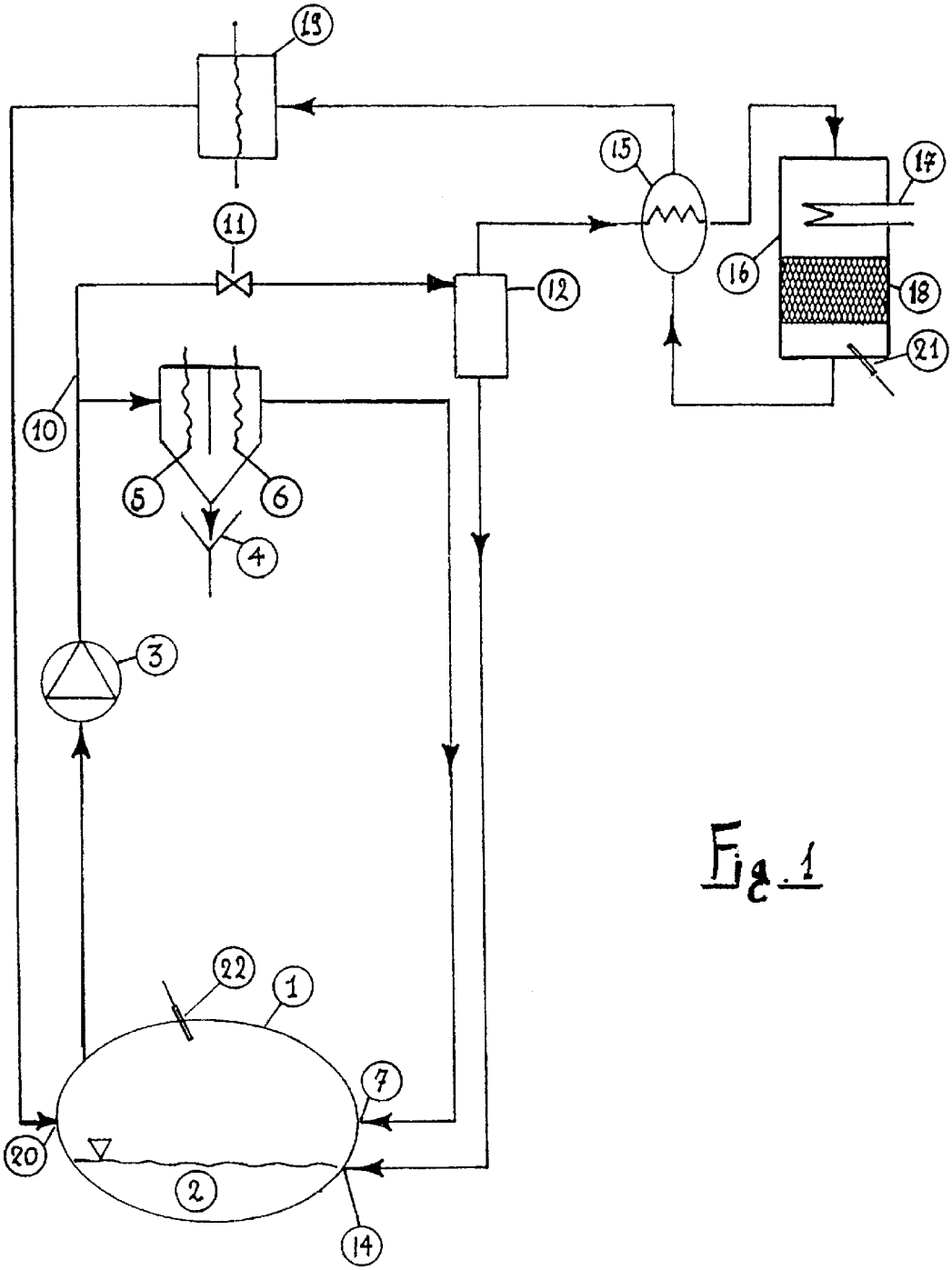
FIG. 1 shows the present operation as a diagrammatic illustration with the addition of the new modifications compared to that of the prior art
Figure 2:
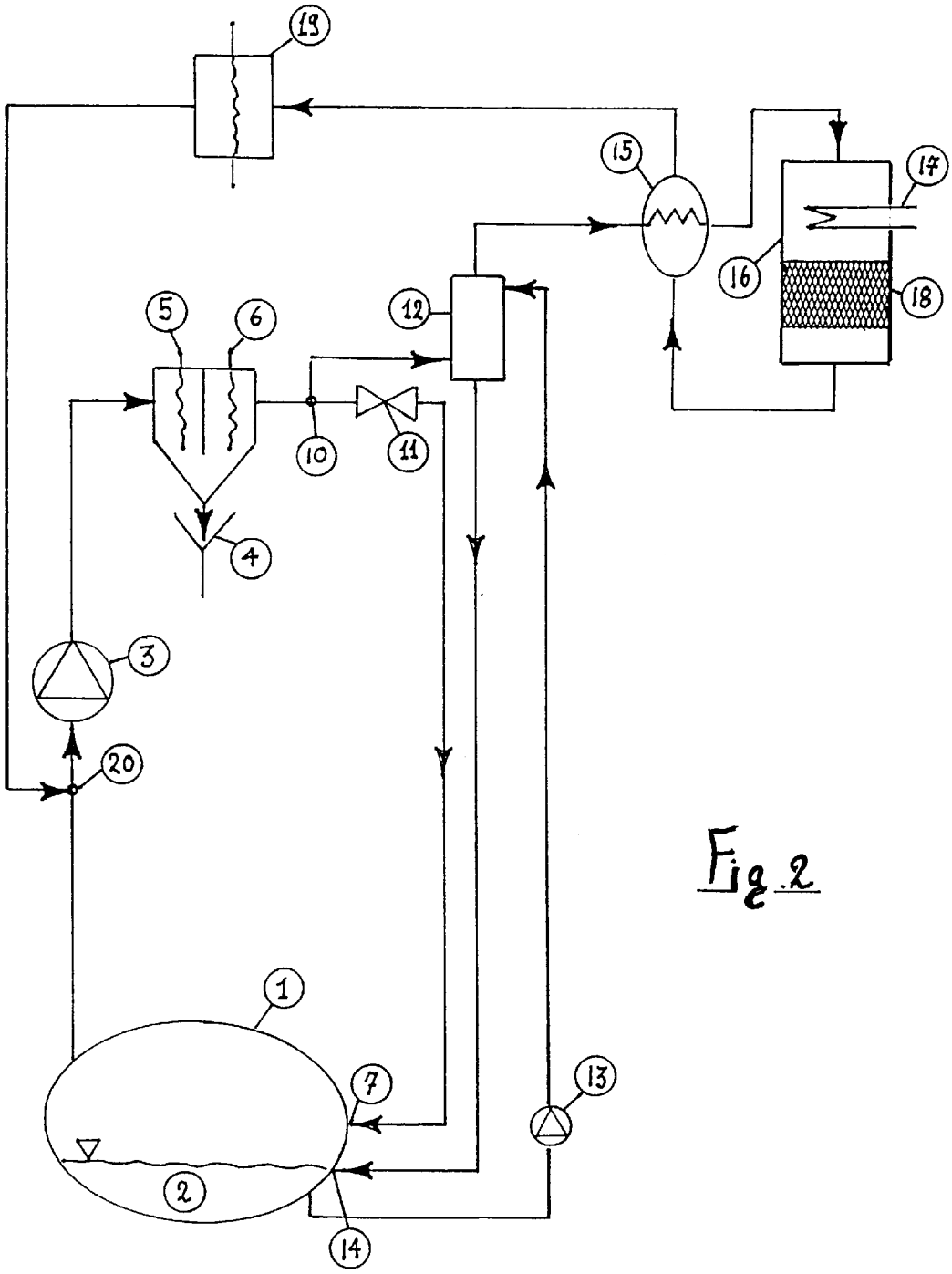
FIG. 2 is a diagrammatic illustration of the system of the prior art Italian patent (BO 99, A 000333).

The space 1 is inside the machine containing both air and a certain amount of solvent 2 in the liquid state. As is known, the air is taken in by a fan 3 and sent in contact with an exchanger or cooling coil 5, cooled by a refrigeration circuit, in order to condensate the water and solvent vapours together with the other volatile substances within the air. The condensation collects in collector 4 then the air heats in contact with a second heating coil 6 that is warmed by means of an appropriate connection to the hot side of the refrigeration circuit. The air thus heated returns finally to the space 1 through passage 7.

As already illustrated in the previous patent application, some of the air pushed by the fan 3 is deflected into passage 10 and by means of the container 12 and the exchanger 15, it reaches the burner 16 that contains the heating element 17 and the catalytic mass 18. The air is outlet from the burner hotter but depleted of oxygen due to the effect of the combustion process. It cools in the exchanger 15 and again in the water refrigerator 19 before it returns to the space 1 through passage 20.

The modifications added to this invention compared to the prior are configuration include first and foremost the addition of at least one oxygen concentration sensor. In the diagram of enclosed FIG. 1, two probes are illustrated with numbers 21 and 22 respectively.

The consequent modifications are listed throughout the description. The air to be conveyed to the burner is deflected into passage 10 immediately downstream from the fan 3 without crossing the coils 5 and 6, cold and hot respectively. It has been noticed that, thanks to the control achieved by the oxygen sensors, the slight temperature variations to which the air drawn and pushed by the fan 3 may be controlled and the consequent difference in the solvent vapour concentration within it can now be tolerated. Consequently the function of the carburetor previously assigned to the tank 12 is outdated and therefore it is no longer necessary to flow into this some liquid solvent by means of a pump. The tank 12 is however still useful as a separator of any drops of liquid pulled in by the air. The solvent thus held back is then returned to space 1 through passage 14. Finally it is now preferred that passage 20 through which the burnt air runs, leads out directly in space 1 rather than immediately downstream from fan 3 as was previously. This enables an improved re-mixing of the air in space 1, an increase in oxygen concentrations and solvent vapours in the flow pushed by the fan.

The oxygen probes 21, 22 used are preferably those known as "Lambda probes" which are often used with catalytic purifiers of the gas outlet from explosion motors. Their operation principle is based on the production of an electromotive force (e.m.f) of electro-chemical nature and precisely the type called e.m.f. of concentration on the two faces of a solid electrolytic pad based on zirconium oxide, respectively exposed to the atmospheric oxygen and the more diluted oxygen in the area to be controlled. The e.m.f collected by means of electrodes is then driven by wires outside the sensor element to be processed with known methods and instruments.

As already mentioned, the most important task assigned to the oxygen sensors is to indicate that a pre-set concentration has been reached and that therefore the elimination process can be stopped. This brings about two advantages: the consumption of solvent is reduced to the smallest amount necessary and the undesired formation of carbon dioxide is avoided. Even if one Lambda probe is sufficient to control the process and considering the reasonable cost of these components, it has been preferred to use more than one for additional safety.

In the example illustrated in FIG. 1, there are two probes. Probe 21 is used to stop the process and, is fitted inside the burner 16 in order to obtain as prompt a reaction as possible. When this indicates that the pre-set concentration has been reached (not necessarily zero) valve 11 closes and shuts off the flow of air to the burner. If there is a failure in the seal, the oxygen concentration may rise again and these abnormal conditions can be detected by probe 22 fitted for this purpose in space 1. Together with providing an alarm signal, the e.m.f sent from probe 22 can trigger the re-opening of the valve 11 together with a new elimination cycle or it can trigger the final stoppage of the machine.

Amongst the various forms of execution of the invention which is substantially identical to that described, even if the parts are different, it may sometimes be preferable to use a separate fan from the main one, operating in parallel with this to send the air from space 1 to the burner 16. In this case valve 11 may be missing and the flow of air to the burner is stopped simply by stopping the fan connected to it. Practically speaking, the execution parts, the sizes, the materials, the shape and other details of the invention may in any event vary without exceeding the domain of this industrial patent right. The invention thus conceived is indeed open to many modifications and variations, all within the sphere of the invention concept. Furthermore, all the components may be replaced with others that are technically equivalent.

I claim:

1. A system for controlling oxygen in an internal atmosphere of a dry cleaning process comprising:

a dry cleaning machine having an internal space;

a circulation fan means connected by a conduit with said internal space, said circulation fan means for drawing air from said internal space;

a first heat exchanger having a cooling coil and a heating coil and a condensate tank, said fan means passing a portion of the drawn air into said first heat exchanger;

a valve means having a first branch and a second branch, said valve means connected to said circulation fan so as to receive another portion of the drawn air;

a second heat exchanger connected to said first branch of said valve means;

a burner connected to said second heat exchanger, said burner having a heating means and a catalytic mass, said heating means for heating said another portion of the drawn air so as to catalytically burn oxygen with solvent vapors, said second heat exchanger connected to an outlet of said burner so as to receive the heated another portion of the drawn air;

a first lambda sensor means fitted inside said burner for measuring an oxygen concentration from the internal atmosphere in said dry cleaning machine, said first lambda sensor means interactive with said valve means for sending a closure signal to said valve means if the oxygen concentration corresponds to a pre-set amount; and a second lambda sensor means installed directly in said internal space of said dry cleaning machine and interactive with said valve means for re-opening said valve means relative to an oxygen concentration in said internal space.

2. The system of claim 1, further comprising:

a container means interposed between said fan means and said second heat exchanger, said container means for separating drops of liquid from said another portion of said drawn air and for conveying the separated drops of liquid to said internal space of said dry cleaning machine.

3. The system of claim 1, said water cooler connected to said dry cleaning machine by a passage such that burnt air passing out of said water cooler passes through said passage into said internal space of said dry cleaning machine.

* * * * *